US006905366B2

(12) United States Patent
Yang

(10) Patent No.: US 6,905,366 B2
(45) Date of Patent: Jun. 14, 2005

(54) CONNECTOR

(75) Inventor: Rick Yang, Taipei (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 10/700,114

(22) Filed: Oct. 31, 2003

(65) Prior Publication Data

US 2005/0095912 A1 May 5, 2005

(51) Int. Cl.[7] ..... H01R 13/648
(52) U.S. Cl. ..... 439/607; 439/608; 439/108
(58) Field of Search ..... 439/607, 557, 439/108, 95, 497, 499, 79, 660

(56) References Cited

U.S. PATENT DOCUMENTS 6,039,611 A * 3/2000 Yang ..... 439/701
6,183,302 B1 * 2/2001 Daikuhara et al. ..... 439/608
6,273,749 B1 * 8/2001 Yang ..... 439/497
6,623,301 B2 * 9/2003 Lappoehn ..... 439/607
6,709,286 B1 * 3/2004 Korsunsky et al. ..... 439/557
6,716,057 B1 * 4/2004 Wu ..... 439/497

* cited by examiner

*Primary Examiner*—Hien Vu

(57) ABSTRACT

A connector includes a plastic core having upper and lower receiving slots, upper and lower rows of terminal slots, and isolating plate slots provided at a central portion, two slide ways provided at two lateral inner sides, and a connecting head provided at a front end thereof; a plurality of terminals located in the terminal slots; a plurality of isolating plates located in the isolating plate slots; two first conductive plates located in the upper and lower receiving slots; an insertion element having two lateral ends slidably engaged with the slide ways on the plastic core, and having a central receiving slot for receiving a second conductive plate therein; and two outer covers enclosing the insertion element in the plastic core, and having two third conductive plates received in receiving recesses provided thereon to contact with the first conductive plates.

11 Claims, 17 Drawing Sheets

B-B′

D-D′

C-C′

A-A′

E-E'

CONNECTOR

FIELD OF THE INVENTION

The present invention relates to a connector, and more particularly to an improved connector that includes individually isolated terminals to avoid mutual interferences between the terminals during transmission of signals at high speed, and to isolate the terminals from external electromagnetic interference (EMI) or crosstalk, so as to enable quicker and more stable transmission of signals via the connector.

BACKGROUND OF THE INVENTION

With the increasingly developed technologies, the applications of computer are also diversified. Various kinds of peripheral products for computers are developed and introduced into markets at extremely quick speed to satisfy the consumers' demands. Under the concept of Time is Money in the current industrial society, it is necessary for a computer to process data as quick as possible. Therefore, the central processing unit (CPU) of a computer has been developed to have extremely high operation speed. Similarly, when the Internet has been highly developed and popularized, the connection of users to different networks has been upgraded from dial-up to broadband to increase the computer's processing speed and save more time. Thus, various peripherals and driving and driven elements for computers must also be designed to provide the same quick processing speed as the CPU. Under this circumstance, cables between the CPU and the driving and driven elements for transmitting signals are very important, and connectors provided at two ends of the cables are particularly important in terms of good signal transmission. While signals are transmitted via the connectors at high speed, the terminals of the connectors inevitably mutually interfere with one another due to a magnetic effect from current, and might be interfered by external interference sources to result in reduced data transmission speed and slow computer processing speed.

FIGS. 21 and 22 are exploded perspective and assembled sectional views, respectively, of a conventional interference-proof connector. As shown, the connector includes a plastic core 130 having a front part enclosed with a steel case 136, and a rear part to which an insertion element 131 is inserted; two signal cables 135 connected to upper and lower sides of the insertion element 131; and two outer covers 132 closed onto upper and lower sides of the insertion element 131 to locate above and below the two signal cables 135. A plurality of terminals 1302 and isolating plates 1303 are inserted into the plastic core 130. The insertion element 131 is provided at upper and lower surfaces with a plurality of isolating ribs 1311, so that a groove is formed between two adjacent isolating ribs 1311 for one terminal 1302 on the plastic core 130 to seat therein. The outer covers 132 are provided at a front side with a plurality of receiving slots 1331 for separately receiving one row of conductive plates 133 therein, and at an inner side with a plurality of isolating ribs 134, which abut on a top of the isolating ribs 1311 on the insertion element 131, so that the conductive plates 133 in the outer covers 132 form isolating layers enclosing the terminals. Therefore, the terminals are isolated from one another to prevent mutual interference between them.

The above-structured connector has the following disadvantages:

1. When the signals are transmitted via the terminals at high speed, the magnetic effect from the current between the terminals is absorbed by the conductive plates 133 in the outer covers. However, electromagnetic interference (EMI) tends to occur at the terminals in the plastic core that are not covered with the conductive plates, and therefore has adverse influence on the signal transmission speed and stability at the connector.
2. There might be static electricity produced around the terminals of the connector due to some external environmental factors, and static electricity forms an interference source of signal transmission.
3. The connector might be affected by interference sources in the external environments to have reduced transmission speed and stability.

It is therefore tried by the inventor to develop an improved connector, so that terminals of the connector do not mutually interfere with one another during signal transmission at high speed, and are isolated from external EMI or crosstalk to ensure quicker and more stable transmission of signals.

SUMMARY OF THE INVENTION

A primary object of the present invention is to provide an improved connector that uses simple structure to prevent mutual interference between terminals of the connector during signal transmission at high speed, so that signals may be transmitted more quickly and stably.

Another object of the present invention is to provide an improved connector that eliminates external interference sources to enable signals to be transmitted more quickly and stably.

To achieve the above and other objects, the connector according to the present invention mainly includes a plastic core having upper and lower receiving slots, upper and lower rows of terminal slots, and isolating plate slots provided at an inner central portion, two slide ways provided at two lateral inner sides, and a connecting head provided at a front end thereof; a set of terminals including a plurality of terminals located in the terminal slots; a set of isolating plates including a plurality of isolating plates located in the isolating plate slots; two first conductive plates located in the upper and lower receiving slots on the plastic core; an insertion element having two lateral ends slidably engaged with the slide ways on the plastic core, and having a central receiving slot for receiving a second conductive plate therein; and two outer covers enclosing the insertion element in the plastic core, and having two third conductive plates received in receiving recesses provided thereon to contact with the first conductive plates in the plastic core.

With the above arrangements, terminals of the connector are individually isolated from one another, so that the terminals do not mutually interfere with one another during signal transmission at high speed. And, since the conductive plates of the connector eliminate electromagnetic interferences (EMI) or crosstalk from internal and external sources, signals may be more quickly and stably transmitted via the connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
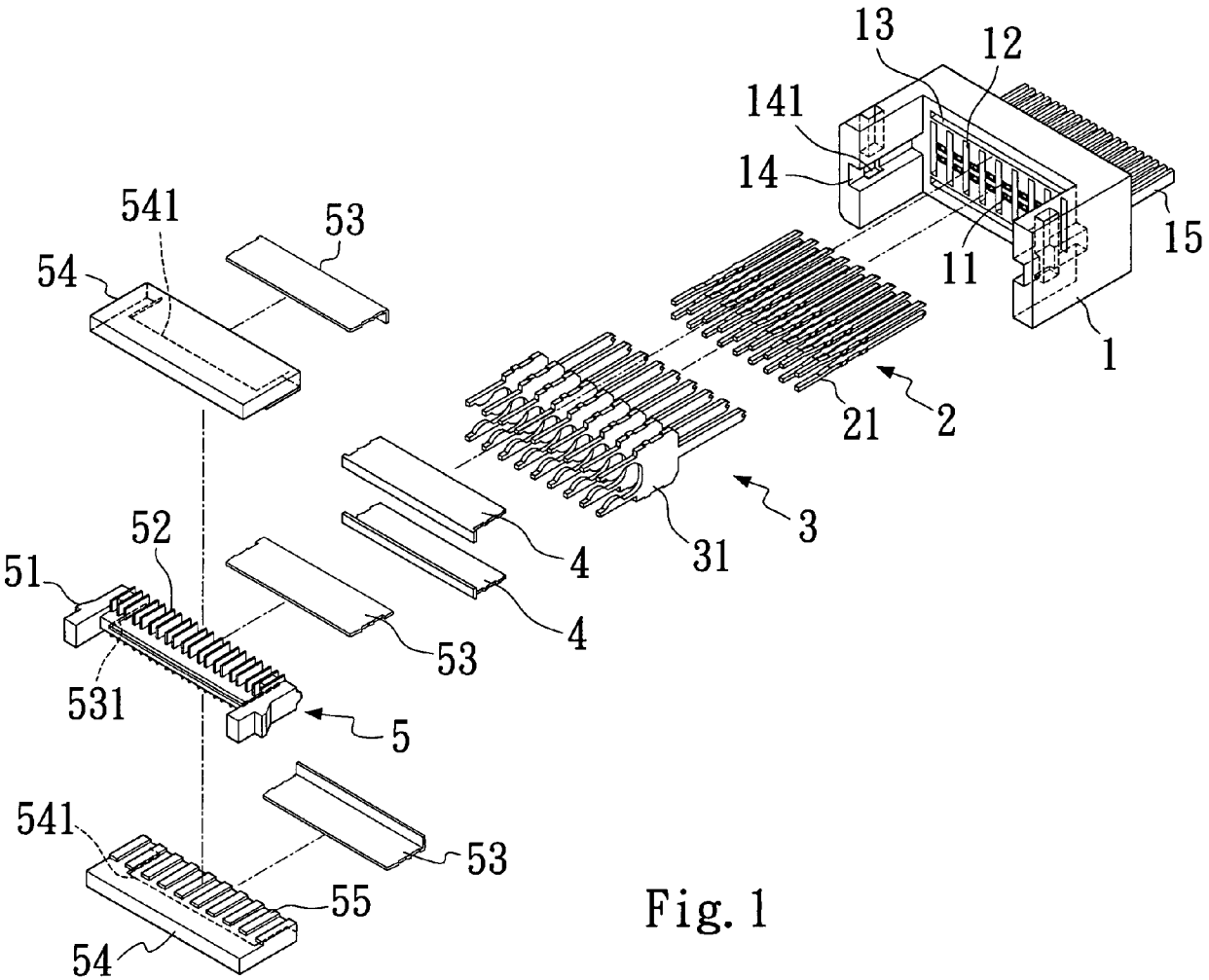
FIG. 1 is an exploded perspective view of a connector according to a first embodiment of the present invention.
Figure 2:
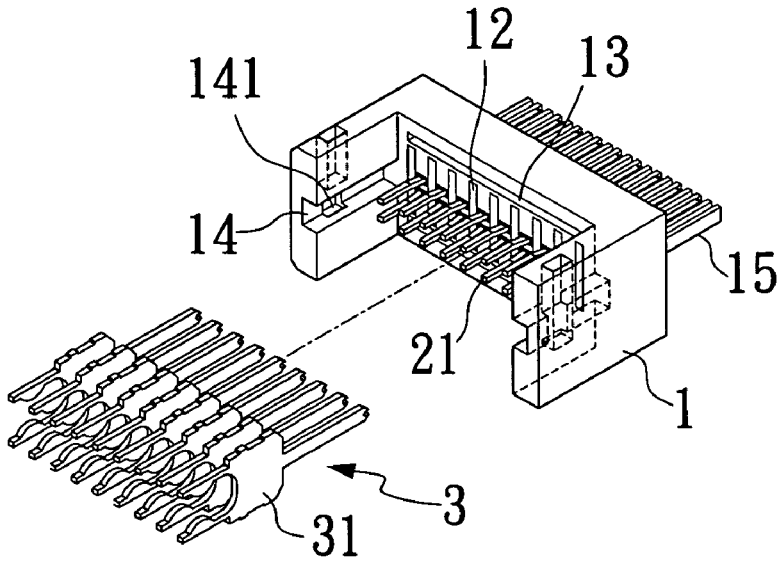
FIG. 2 is a partially assembled perspective view of the connector of FIG. 1.
Figure 3:
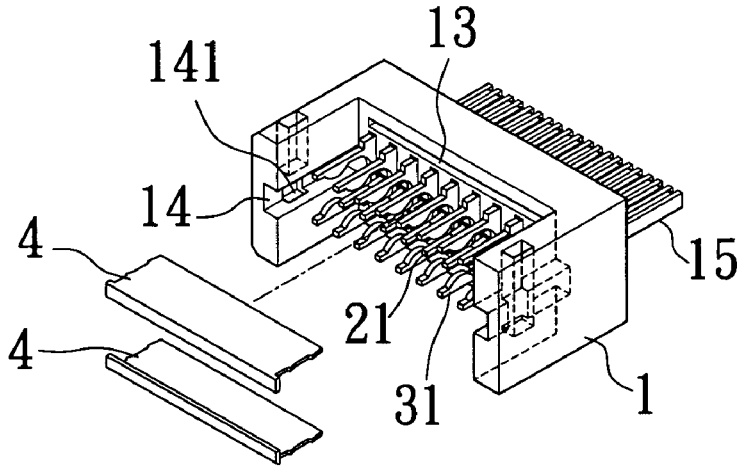
FIG. 3 is a further partially assembled perspective view of the connector of FIG. 1.

Please refer to FIG. 1 that is an exploded perspective view of a connector according to a first embodiment of the present invention, and to FIGS. 2 and 3 that are partially assembled perspective views of the connector of FIG. 1. As shown, the connector mainly includes a plastic core 1, a set of terminals 2, a set of first isolating plates 3, two first conductive plates 4, and an insertion element 5.

The plastic core 1 is provided on an inner central portion at upper and lower sides thereof with upper and lower receiving slots 13, and at an area of the inner central portion between the upper and lower receiving slots 13 with a plurality of alternately arranged terminal slots 11 and isolating plate slots 12. The terminal slots 11 are divided into an upper and a lower row. The plastic core 1 is also provided at each of two lateral inner sides with a slide way 14, in which a retaining slot 141 is provided at a predetermined position. A connecting head 15 is externally provided at a front end of the plastic core 1.

The set of terminals 2 includes a plurality of terminals 21 adapted to separately insert into the upper and the lower row of terminal slots 11 to associate with the plastic core 1.

The set of first isolating plates 3 includes a plurality of first isolating plates 31 adapted to separately insert into the isolating plate slots 12 to associate with the plastic core 1.

The two first conductive plates 4 are adapted to separately insert into the upper and the lower receiving slot 13 to associate with the plastic core 1. The first conductive plates 4 received in the upper and lower receiving slots 13 are located above and below the set of terminals 2 to eliminate interference between the terminals 21 in the plastic core 1, as well as external interference sources adversely affecting the plastic core 1, so as to ensure quicker and more stable transmission of signals via the connector.

Figure 4:
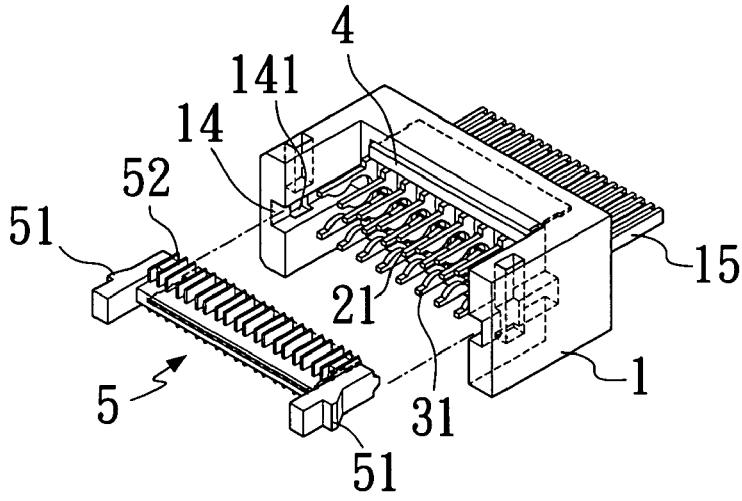
FIG. 4 shows the assembling of an insertion element to a plastic core of the connector of FIG. 1.

FIG. 4 shows the assembling of the insertion element 5 to the plastic core 1. As shown, the insertion element 5 is provided at each of two lateral outer sides with a projection 51, which is adapted to engage with a corresponding one of the retaining slots 141 provided on the slide ways 14 of the plastic core 1 and thereby firmly connect the insertion element 5 to the plastic core 1. As can be seen from FIG. 1, the insertion element 5 is transversely provided with a central receiving slot 531 for receiving a second conductive plate 53 therein, so as to eliminate mutual interference of the upper row of terminals 11 with the lower row of terminals 11 during transmission of signals. The insertion element 5 is provided at upper and lower sides with second isolating plates 52 corresponding to the set of terminals 2.

Figure 5:
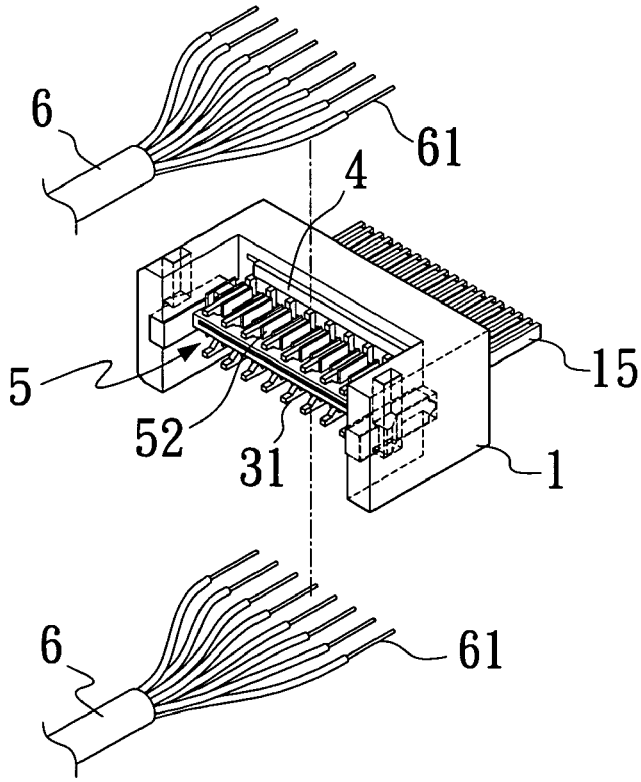
FIG. 5 shows the connection of signal cables to terminals of the connector of FIG. 1.

Please refer to FIG. 5 that shows the connection of two signal cables 6 to the set of terminals 2. As shown, terminals 61 of the signal cables 6 are separately connected to the terminals 21 in the set of terminals 2 for sending signals.

Figure 6:
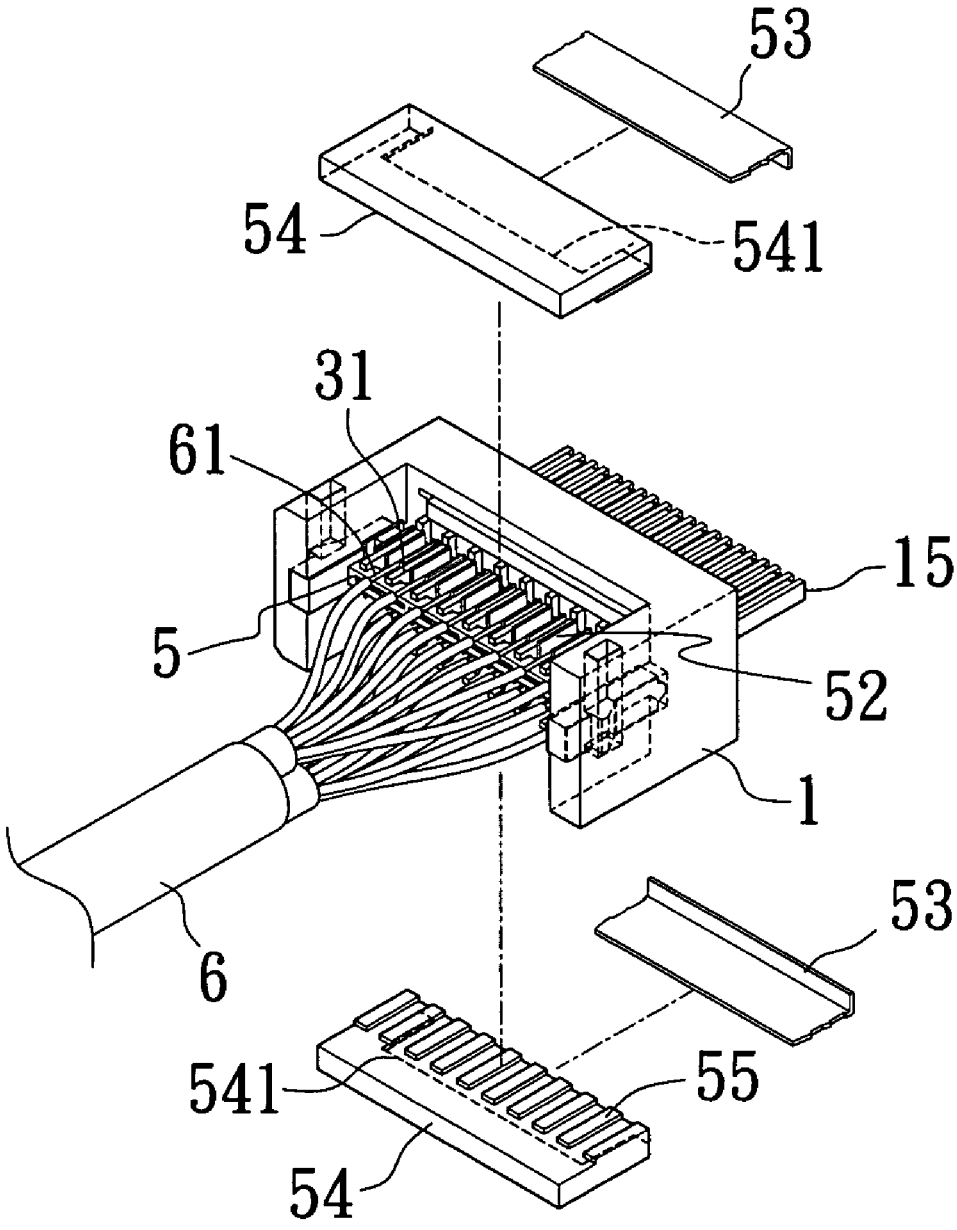
FIG. 6 shows the assembling of outer covers to the plastic core of the connector of FIG. 1.
Figure 7:
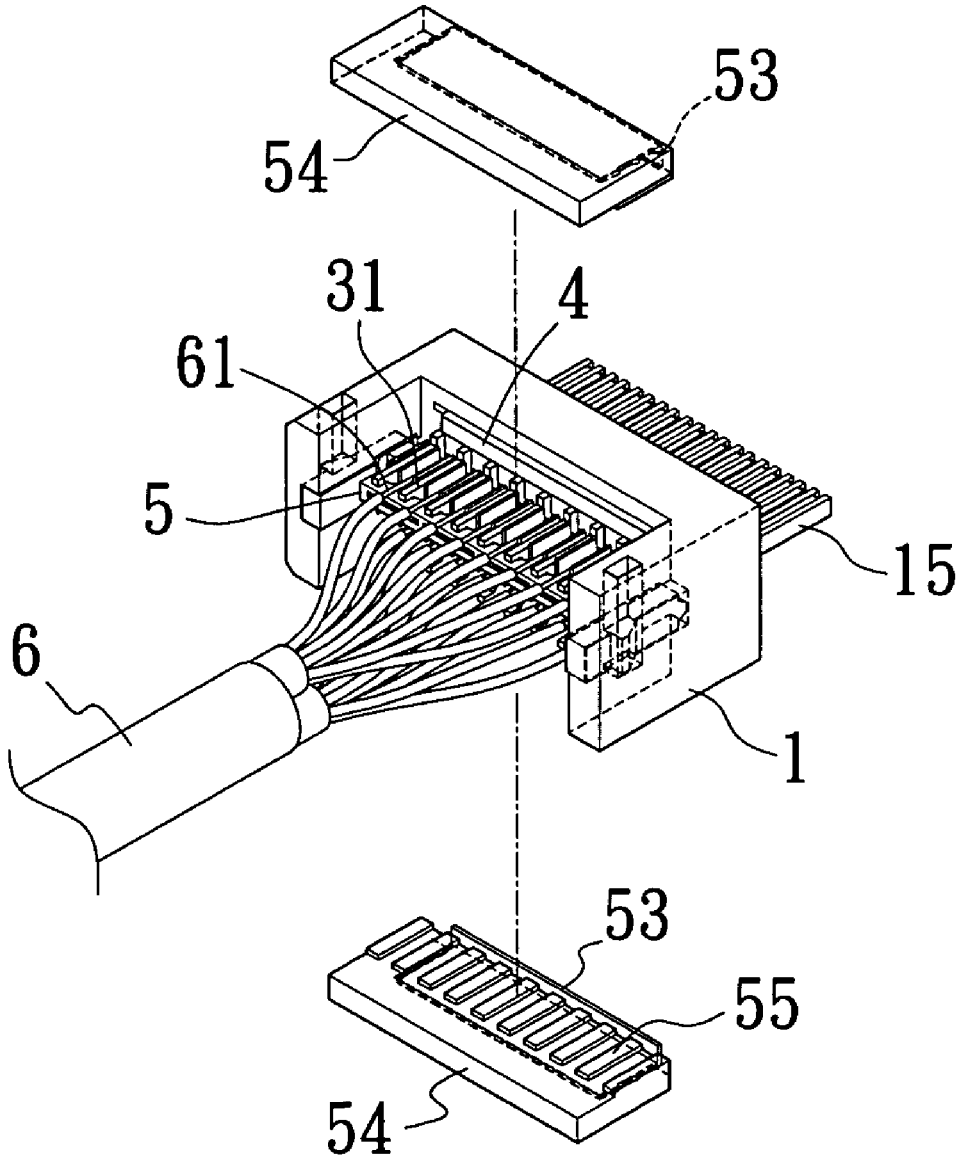
FIG. 7 is another view showing the assembling of outer covers to the plastic core of the connector of FIG. 1.
Figure 8A:
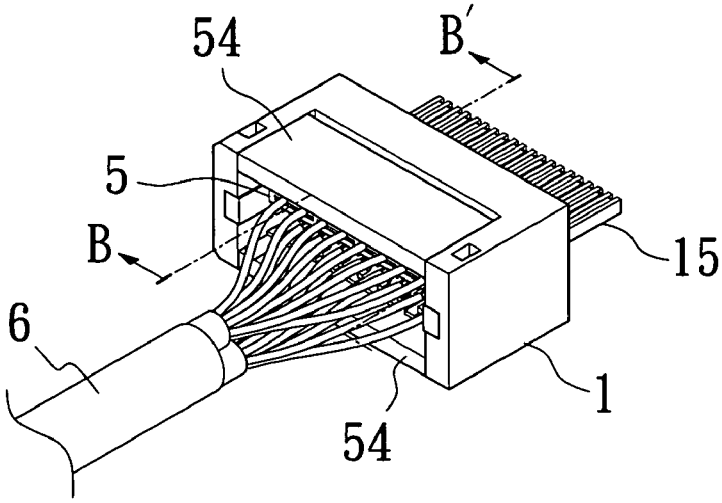
FIG. 8*a* is a fully assembled perspective view of the connector of FIG. 1.
Figure 8B:
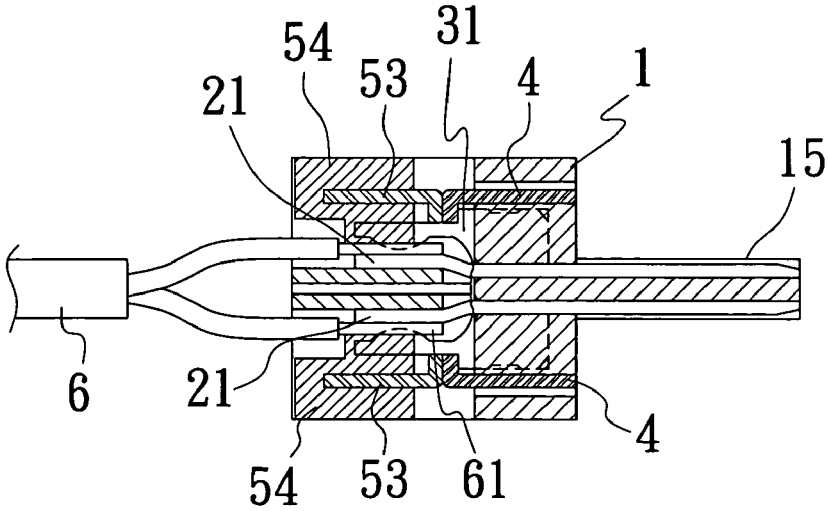
FIG. 8*b* is a cross sectional view taken along line B–B' of FIG. 8*a;*

Please refer to FIGS. 6, 7, and 8*a* that together show the assembling of two outer covers 54 to the plastic core 1. As shown, the outer covers 54 are located at upper and lower sides of the insertion element 5 to enclose the insertion element 5 in the plastic core 1. Each of the outer covers 54 is provided at an inner side with a plurality of isolating ribs 55 corresponding to and covering spaces between the second isolating plates 52 on the insertion element 5. Each of the outer covers 54 is also internally provided at a predetermined position with a transverse recess 541, into which a third conductive plate 53 is received. FIG. 8*b* is a cross sectional view taken along line B–B' of FIG. 8*a*. Please refer to FIG. 8*b*. The third conductive plates 53 received in the two outer covers 54 are in contact with the first conductive plates 4 received in the plastic core 1, enabling the connector of the present invention to have enhanced interference-shielding effect and increased shielding area to enable quicker and more stable signal transmission.

Figure 9:
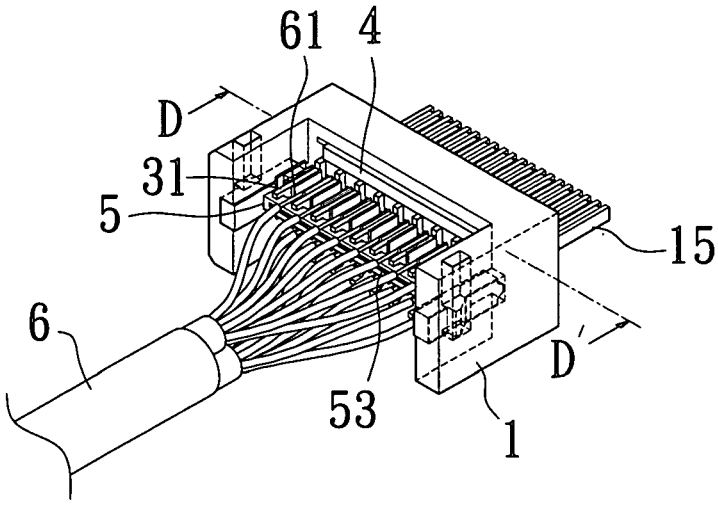
FIG. 9 is an assembled perspective view of the connector of FIG. 1 with the outer covers removed therefrom.
Figure 10:
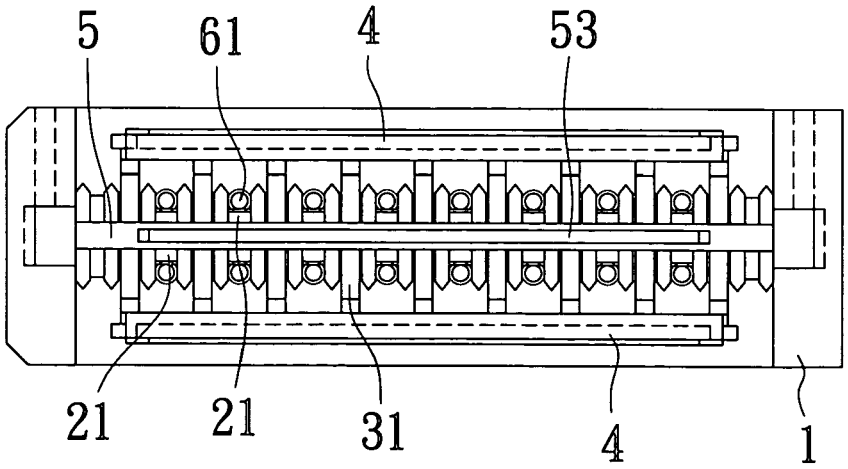
FIG. 10 is a cross sectional view taken along line D–D' of FIG. 9.

FIG. 9 is a fully assembled perspective view of the connector of FIG. 1 with the outer covers 54 removed therefrom. FIG. 10 is a cross sectional view taken along line D–D' of FIG. 9. As shown, in the fully assembled connector of the present invention, the first isolating plates 31 together form a plurality of isolated cells separating and isolating individual terminals 21 from one another, and the first conductive plates 4 eliminate the interferences between the terminals 21 and from external environments, so that signals maybe transmitted via the connector more quickly and stably.

Figure 11:
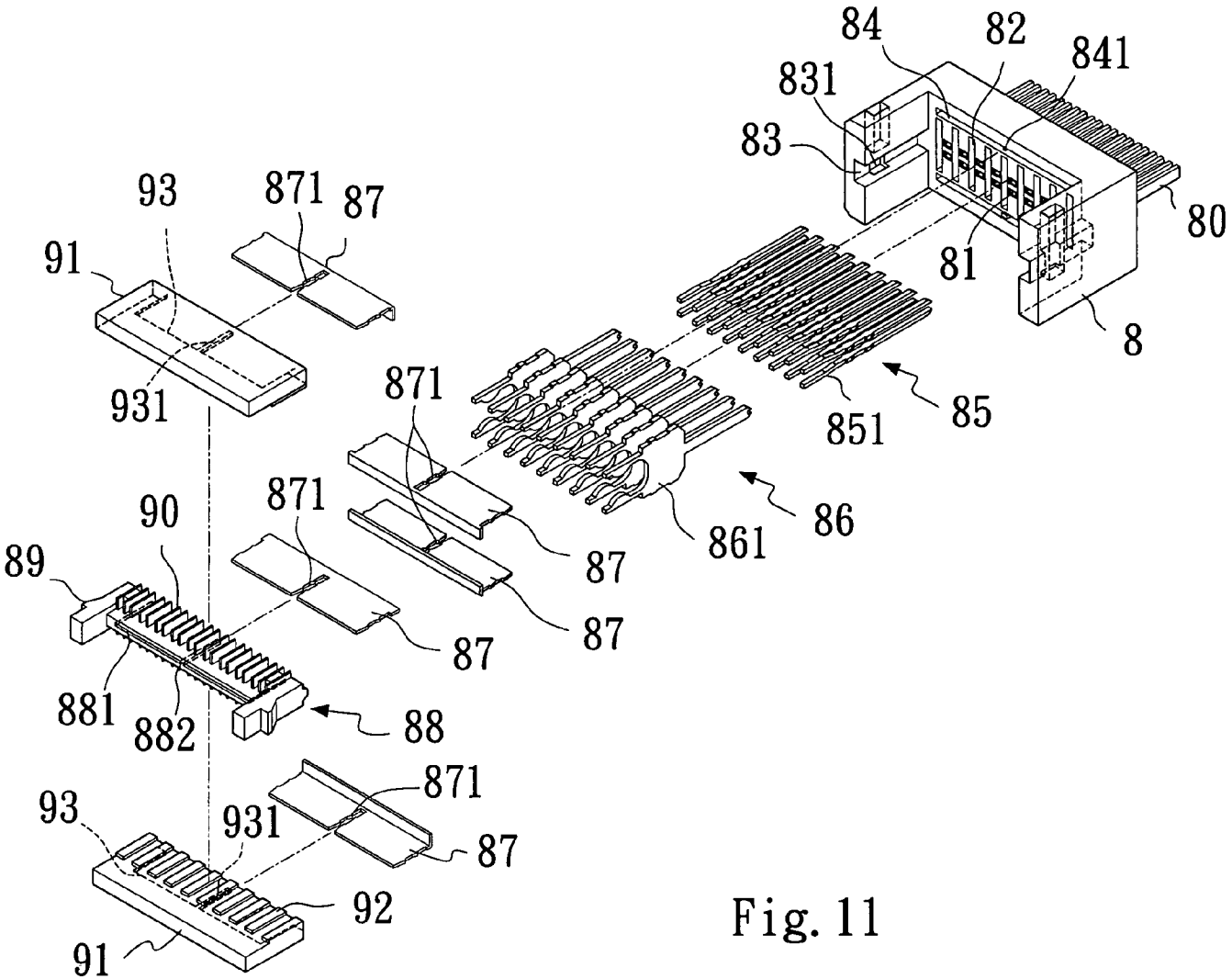
FIG. 11 is an exploded perspective view of a connector according to a second embodiment of the present invention.
Figure 12:
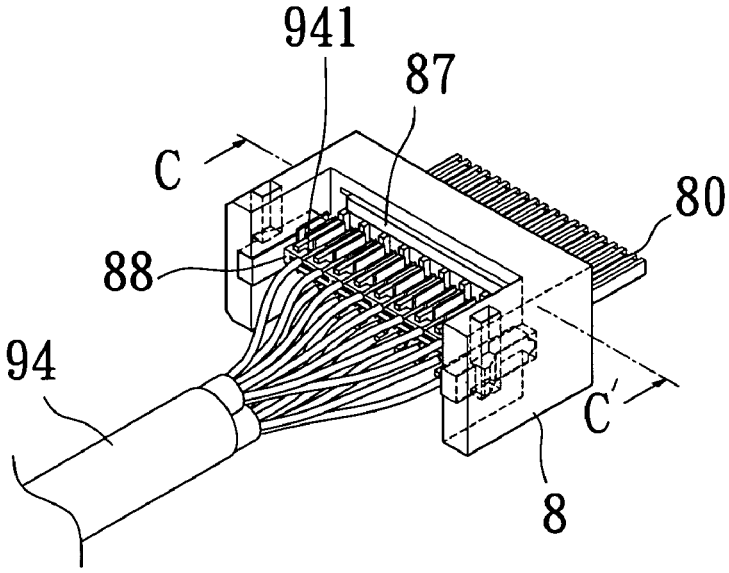
FIG. 12 is an assembled perspective view of the connector of FIG. 11 with outer covers removed therefrom.

FIGS. 11 and 12 are exploded and partially assembled perspective views, respectively, of a connector according to a second embodiment of the present invention. As shown, the connector of the second embodiment mainly includes a plastic core 8, a set of terminals 85, a set of first isolating plates 86, first, second, and third conductive plates 87, an insertion element 88, and two outer covers 91.

The plastic core 8 is provided on an inner central portion at upper and lower sides thereof with upper and lower receiving slots 84 respectively having a central rib 841, and at an area of the inner central portion between the upper and lower receiving slots 84 with a plurality of alternately arranged terminal slots 81 and isolating plate slots 82. The terminal slots 81 are divided into an upper and a lower row. The plastic core 8 is also provided at each of two lateral inner sides with a slide way 83, in which a retaining slot 831 is provided at a predetermined position. A connecting head 80 is externally provided at a front end of the plastic core 8.

The set of terminals 85 includes a plurality of terminals 851 adapted to separately insert into the upper and the lower row of terminal slots 81 to associate with the plastic core 8.

The set of first isolating plates 86 includes a plurality of first isolating plates 861 adapted to separately insert into the isolating plate slots 82 to associate with the plastic core 8.

There are two first conductive plates 87 respectively provided with a central slit 871 and adapted to separately insert into the upper and the lower receiving slot 84 with the central slits 871 engaged with the central ribs 841 to thereby firmly associate with the plastic core 8.

The insertion element 88 is transversely provided with a central receiving slot 881 having a central rib 882, so that one second conductive plate 87 having a central slit 871 is received therein with the central slit 871 engaged with the central rib 882 to firmly hold the second conductive plate 87 in the central receiving slot 881 to eliminate mutual interference of the upper row of terminals 851 with the lower row of terminals 851 during transmission of signals. The insertion element 88 is provided at upper and lower sides with second isolating plates 90 corresponding to the set of terminals 85. The insertion element 88 is also provided at each of two lateral outer sides with a projection 89, which is adapted to engage with a corresponding one of the retaining slots 831 provided on the slide ways 83 of the plastic core 8 and thereby firmly connect the insertion element 88 to the plastic core 8.

The outer covers 91 are located at upper and lower sides of the insertion element 88 to enclose the insertion element 88 in the plastic core 8. Each of the outer covers 91 is provided at an inner side with a plurality of isolating ribs 92 corresponding to and covering spaces between the second isolating plates 90 on the insertion element 88. Each of the outer covers 91 is also internally provided at a predetermined position with a transverse recess 93 having a central rib 931, into which a third conductive plate 87 having a central slit 871 is received with the central slit 871 engaged with the central rib 931 and thereby firmly hold the third conductive plate 87 in the transverse recess 93. The third conductive plates 87 received in the two outer covers 91 are in contact with the first conductive plates 87 received in the plastic core 8. Finally, terminals 941 of two signal cables 94 are separately connected to the terminals 851 of the set of terminals 85 to enable transmission of signals. The contact of the third conductive plates 87 received in the outer covers 91 with the first conductive plates 87 received in the plastic core 8 enables the connector of the present invention to have enhanced interference-shielding effect and increased shielding area and accordingly provides quicker and more stable signal transmission.

Figure 13:
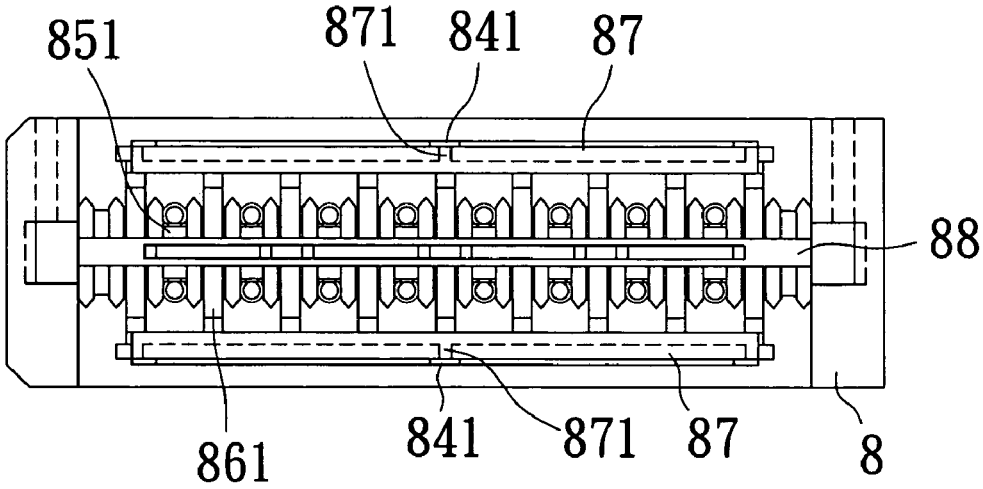
FIG. 13 is a cross sectional view taken along line C–C' of FIG. 12.

FIG. 13 is a cross sectional view taken along line C–C' of FIG. 12. Please refer to FIG. 13. As shown, in the fully assembled connector according to the second embodiment of the present invention, the first isolating plates 861 together form a plurality of isolated cells that separate and isolate individual terminals 851 from one another, and the two first conductive plates 87 eliminate the interferences between the terminals 851 and from external environments, so that signals may be transmitted via the connector more quickly and stably. Moreover, with the engagement of the central slits 871 on the first conductive plates 87 with the central ribs 841 in the upper and lower receiving slots 84 on the plastic core 8, the central slits 871 on the second conductive plate 87 with the central rib 882 in the central receiving slot 881 of the insertion element 88, and the central slits 871 on the third conductive plates 87 with the central ribs 931 in transverse recesses 93 of the outer covers 91, the first, the second, and the third conductive plates 87 may be firmly held to the plastic core 8, the insertion element 88, and the outer covers 91, respectively.

Figure 14:
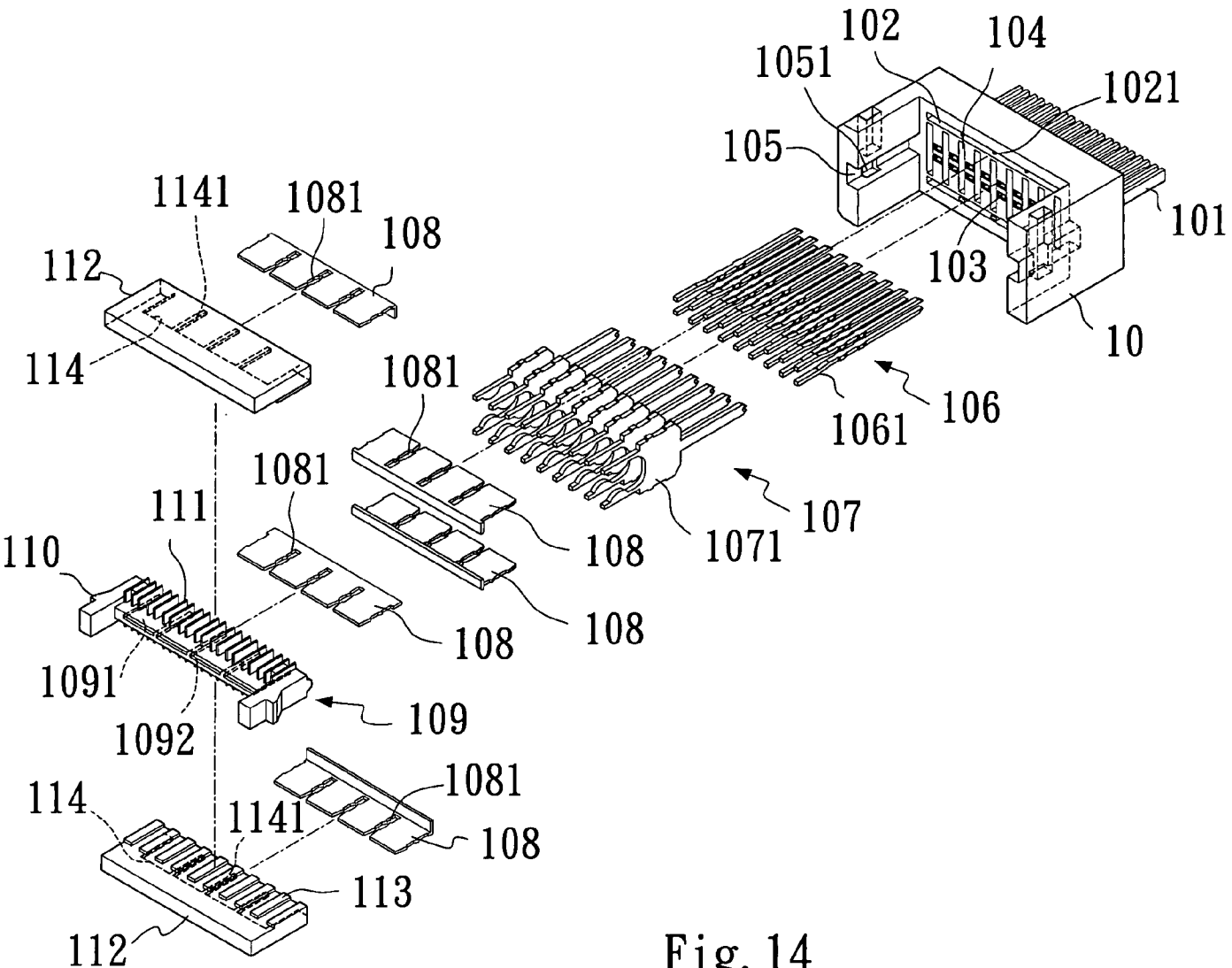
FIG. 14 is an exploded perspective view of a connector according to a third embodiment of the present invention.
Figure 15:
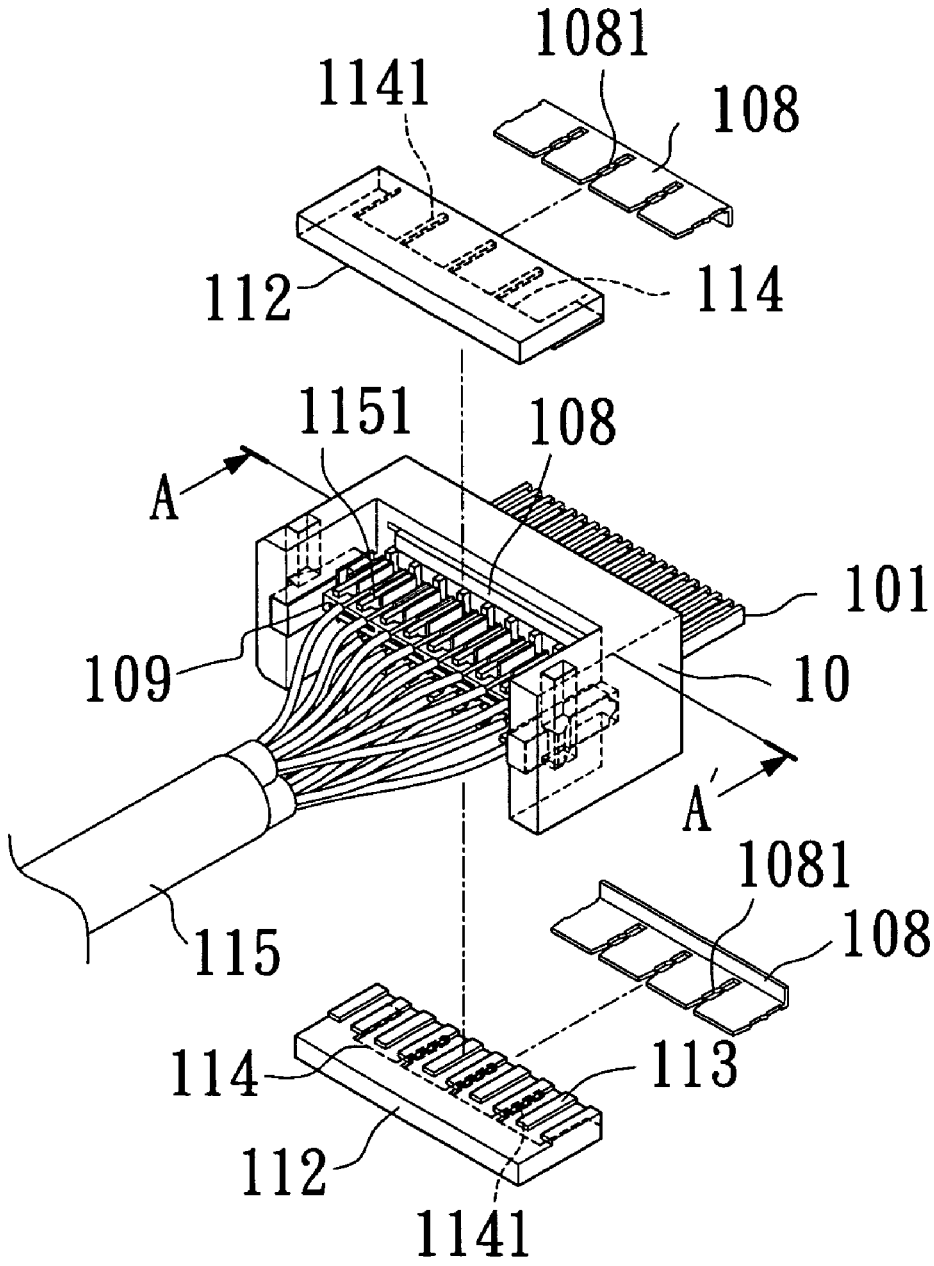
FIG. 15 is a partially assembled perspective view of the connector of FIG. 14 before the outer covers are assembled to the connector.

FIGS. 14 and 15 are exploded and partially assembled perspective views, respectively, of a connector according to a third embodiment of the present invention. As shown, the connector of the third embodiment mainly includes a plastic core 10, a set of terminals 106, a set of first isolating plates 107, first, second, and third conductive plates 108, an insertion element 109, and two outer covers 112.

The plastic core 10 is provided on an inner central portion at upper and lower sides thereof with upper and lower receiving slots 102 respectively having a plurality of equally spaced rib 1021 provided therein, and at an area of the inner central portion between the upper and lower receiving slots 102 with a plurality of alternately arranged terminal slots 103 and isolating plate slots 104. The terminal slots 103 are divided into an upper and a lower row. The plastic core 10 is also provided at each of two lateral inner sides with a slide way 105, in which a retaining slot 1051 is provided at a predetermined position. A connecting head 101 is externally provided at a front end of the plastic core 10.

The set of terminals 106 includes a plurality of terminals 1061 adapted to separately insert into the upper and the lower row of terminal slots 103 to associate with the plastic core 10.

The set of first isolating plates 107 includes a plurality of first isolating plates 1071 adapted to separately insert into the isolating plate slots 104 to associate with the plastic core 10.

There are two first conductive plates 108 respectively provided with a plurality of equally spaced slits 1081 and adapted to separately insert into the upper and the lower receiving slot 102 with the slits 1081 engaged with the ribs 1021 to thereby firmly associate with the plastic core 10.

The insertion element 109 is transversely provided with a central receiving slot 1091 having a plurality of equally spaced ribs 1092 formed in the slot 1091, so that a second conductive plate 108 having a plurality of equally spaced slits 1081 is received therein with the slits 1081 engaged with the ribs 1092 to firmly hold the second conductive plate 108 in the central receiving slot 1091 to eliminate mutual interference of the upper row of terminals 1061 with the lower row of terminals 1061 during transmission of signals. The insertion element 109 is provided at upper and lower sides with second isolating plates 111 corresponding to the set of terminals 106. The insertion element 109 is also provided at each of two lateral outer sides with a projection 110, which is adapted to engage with a corresponding one of the retaining slots 1051 provided on the slide ways 105 of the plastic core 10 and thereby firmly connect the insertion element 109 to the plastic core 10.

The outer covers 112 are located at upper and lower sides of the insertion element 109 to enclose the insertion element 109 in the plastic core 10. Each of the outer covers 112 is provided at an inner side with a plurality of isolating ribs 113 corresponding to and covering spaces between the second isolating plates 111 on the insertion element 109. Each of the outer covers 112 is also internally provided at a central position with a transverse recess 114 having a plurality of equally spaced ribs 1141, into which a third conductive plate 108 having a plurality of equally spaced slits 1081 is received with the slits 1081 engaged with the ribs 1141 and thereby firmly hold the third conductive plate 108 in the transverse recess 114. The third conductive plates 108 received in the two outer covers 112 are in contact with the first conductive plates 108 received in the plastic core 10. Finally, terminals 1151 of two signal cables 115 are separately connected to the terminals 1061 of the set of terminals 106 to enable transmission of signals. The contact of the third conductive plates 108 received in the outer covers 112 with the first conductive plates 108 received in the plastic core 10 enables the connector according to the third embodiment of the present invention to have enhanced interference-shielding effect and increased shielding area and accordingly provides quicker and more stable signal transmission.

Figure 16:
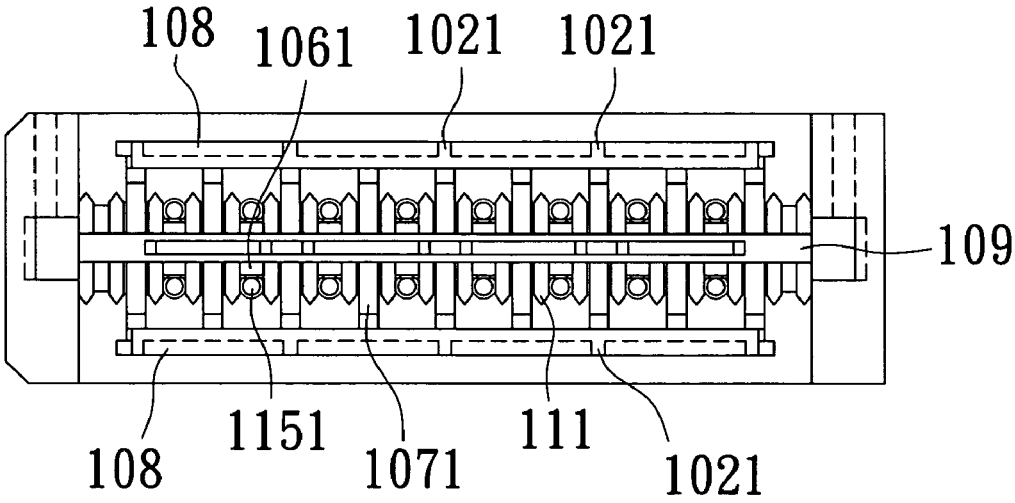
FIG. 16 is a cross sectional view taken along line A–A' of FIG. 15.

FIG. 16 is a cross sectional view taken along line A–A' of FIG. 15. Please refer to FIG. 16. As shown, in the fully assembled connector according to the third embodiment of the present invention, the first isolating plates 1071 together form a plurality of isolated cells that separate and isolate individual terminals 1061 from one another, and the two first conductive plates 108 eliminate the interferences between the terminals 1061 and from external environments, so that signals may be transmitted via the connector more quickly and stably. Moreover, with the engagement of the slits 1081 on the first conductive plates 108 with the ribs 1021 in the upper and lower receiving slots 102 on the plastic core 10, the slits 1081 on the second conductive plate 108 with the ribs 1092 in the central receiving slot 1091 of the insertion element 109, and the slits 1081 on the third conductive plates 108 with the ribs 1141 in transverse recesses 114 of the outer covers 112, the first, the second, and the third conductive plates 108 may be firmly held to the plastic core 10, the insertion element 109, and the outer covers 112, respectively.

Figure 17:
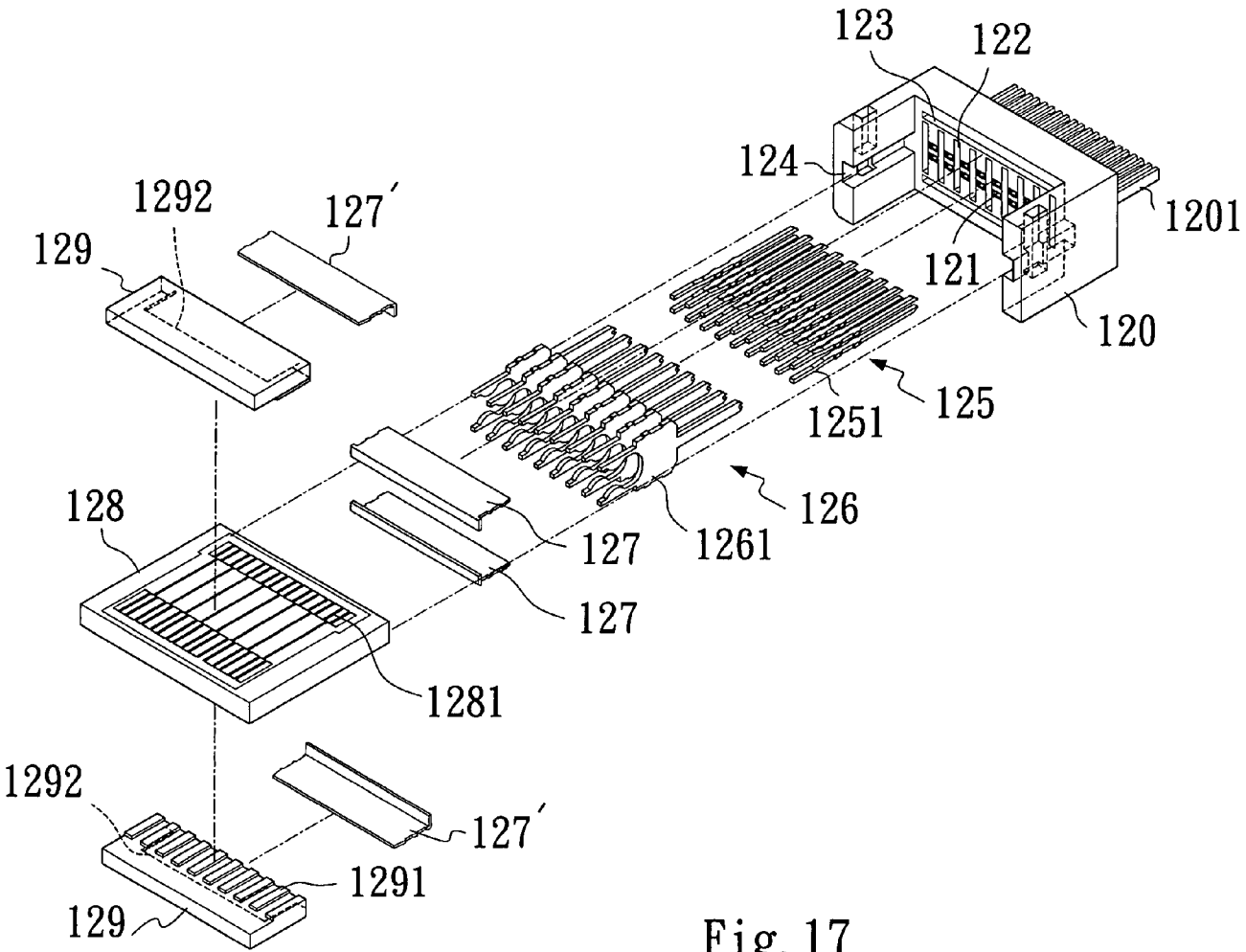
FIG. 17 is an exploded perspective view of a connector according to a fourth embodiment of the present invention.
Figure 18:
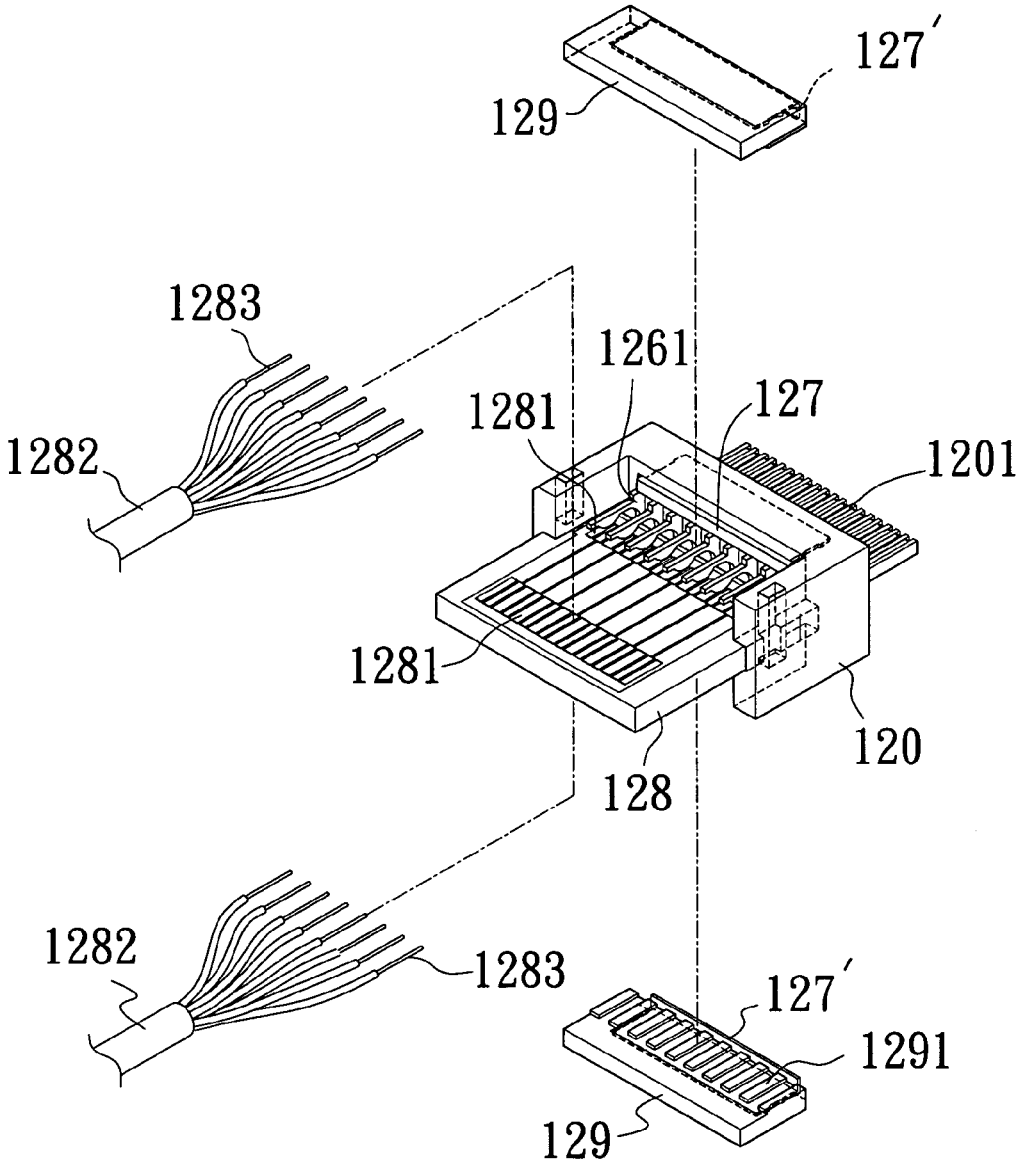
FIG. 18 is a partially assembled perspective view of the connector of FIG. 17.
Figure 19:
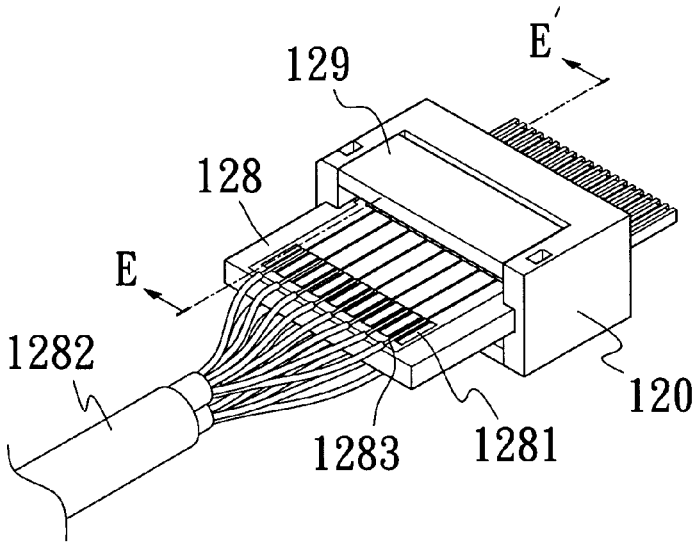
FIG. 19 is a fully assembled perspective view of the connector of FIG. 17.

Please refer to FIG. 17 that is an exploded perspective view of a connector according to a fourth embodiment of the present invention, and to FIGS. 18 and 19 that are partially and fully assembled perspective views, respectively, of the connector of FIG. 17. As shown, the connector of the fourth embodiment mainly includes a plastic core 120, a set of terminals 125, a set of isolating plates 126, two first conductive plates 127, two third conductive plates 127', an insertion element 128, and two outer covers 129.

The plastic core 120 is provided on an inner central portion at upper and lower sides thereof with upper and lower receiving slots 123, and at an area of the inner central portion between the upper and lower receiving slots 123 with a plurality of alternately arranged terminal slots 121 and isolating plate slots 122. The terminal slots 121 are divided into an upper and a lower row. The plastic core 120 is also provided at each of two lateral inner sides with a slide way l24. A connecting head 1201 is externally provided at a front end of the plastic core 120.

The set of terminals 125 includes a plurality of terminals 1251 adapted to separately insert into the upper and the lower row of terminal slots 121 to associate with the plastic core 120.

The set of isolating plates 126 includes a plurality of isolating plates 1261 adapted to separately insert into the isolating plate slots 122 to associate with the plastic core 120.

The two first conductive plates 127 are adapted to separately insert into the upper and the lower receiving slot 123 to thereby firmly associate with the plastic core 120.

The insertion element 128 may be a printed circuit board (PCB) adapted to slide along the slide ways 124 on the plastic core 120. The insertion element 128 is provided at upper and lower sides with printed circuits 1281 corresponding to the set of terminals 125. The insertion element 128 is largely structurally simplified as compared with the insertion elements in the first, the second, and the third embodiment. The second isolating plates on the insertion elements in other embodiments are omitted to enable reduced manufacturing cost of the connector.

The outer covers 129 are located at upper and lower sides of the insertion element 128 to enclose the insertion element 128 in the plastic core 120. Each of the outer covers 129 is provided at an inner side with a plurality of isolating ribs 1291 corresponding to and covering spaces between the printed circuits 1281 on the insertion element 128. Each of the outer covers 129 is also internally provided at a central position with a transverse recess 1292, into which a third conductive plate 127' is received. The third conductive plates 127' received in the two outer covers 129 are in contact with the first conductive plates 127 received in the plastic core 120. Finally, terminals 1283 of two signal cables 1282 are separately connected to the printed circuits 1281 on the insertion element 128 to enable transmission of signals. The contact of the third conductive plates 127' received in the outer covers 129 with the first conductive plates 127 received in the plastic core 120 enables the connector according to the fourth embodiment of the present invention to have enhanced interference-shielding effect and increased shielding area and accordingly provides quicker and more stable signal transmission.

Figure 20:
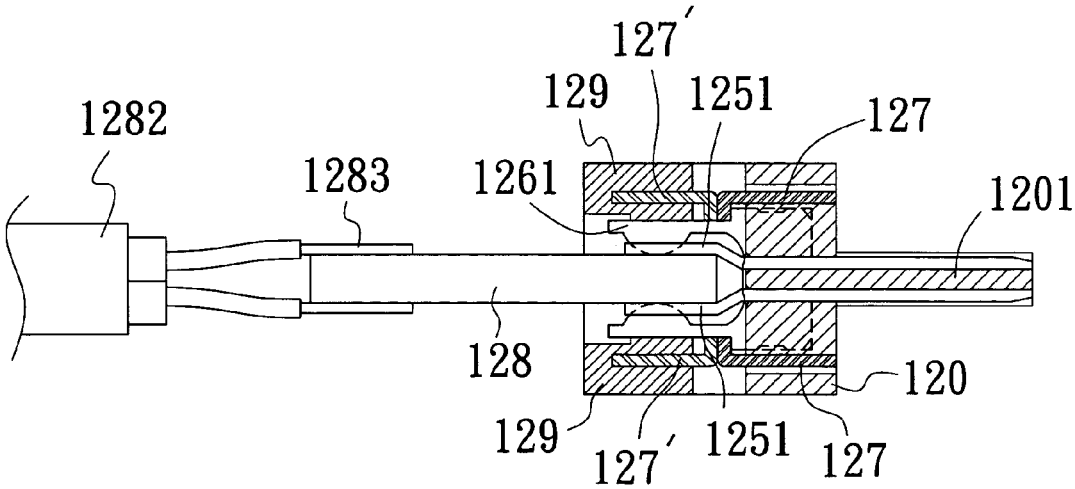
FIG. 20 is a cross sectional view taken along ling E–E' of FIG. 19.
Figure 21:
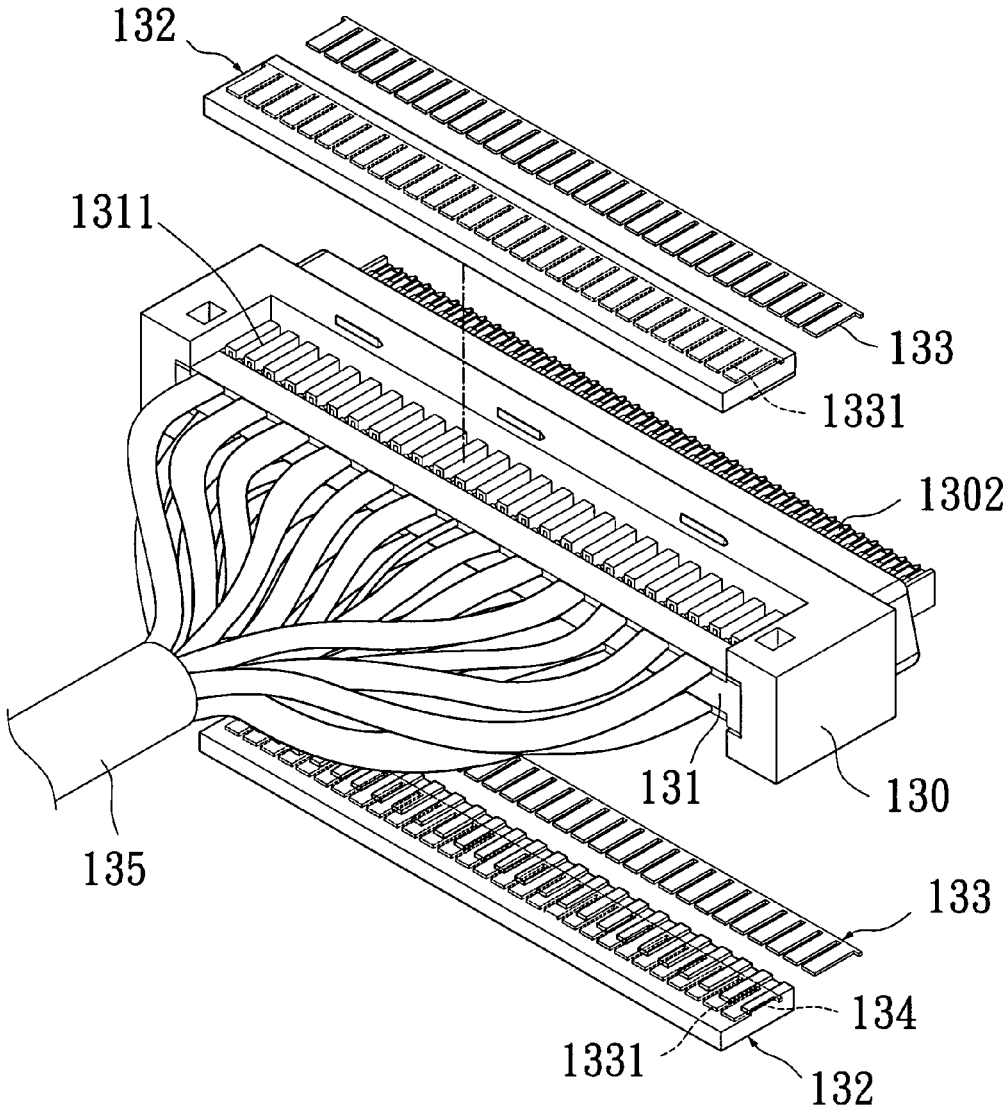
(PRIOR ART) Fig. 21
FIG. 21 is a partially assembled perspective view of a conventional EMI-proof connector.
Figure 22:
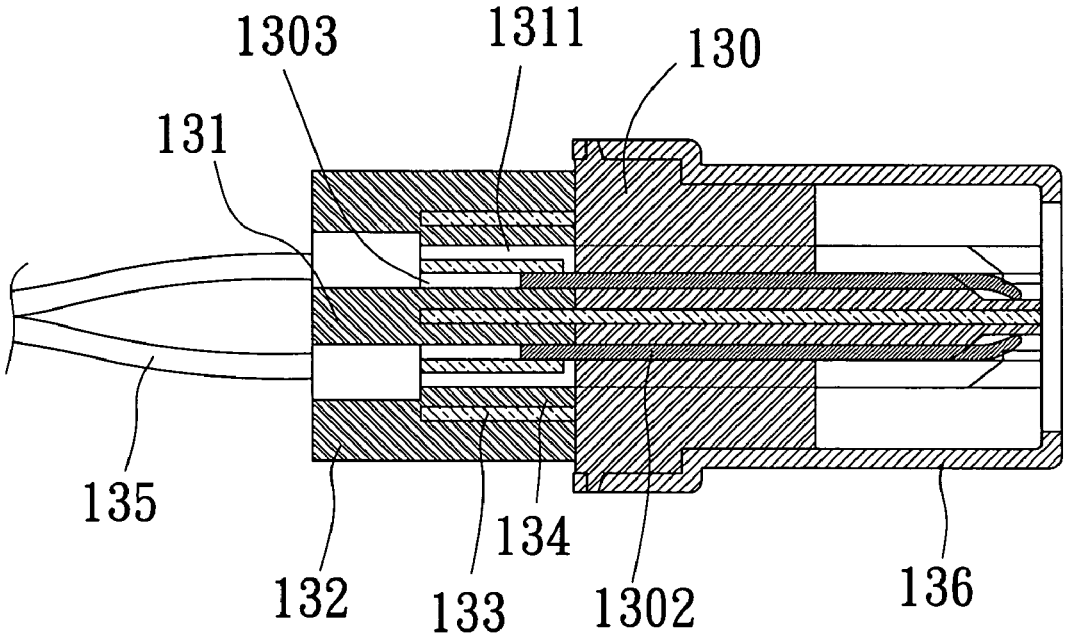
(PRIOR ART) Fig. 22
FIG. 22 is a side sectional view of the conventional EMI-proof connector of FIG. 21.

FIG. 20 is a cross sectional view taken along line E–E' of FIG. 19. Please refer to FIG. 20. As shown, in the connector according to the fourth embodiment of the present invention, the insertion element 128 has simplified structure to enable a reduced manufacturing cost of the connector. And, in the fully assembled connector of the fourth embodiment of the present invention, the isolating plates 1261 together form a plurality of isolated cells that separate and isolate individual terminals 1251 from one another, and the first and third conductive plates 127, 127' eliminate the interferences between the terminals 1251 and from external environments, so that signals may be transmitted via the connector more quickly and stably.

With the above arrangements, terminals of the connector are individually isolated from one another, so that the terminals do not mutually interfere with one another during signal transmission at high speed. And, since the conductive plates of the connector eliminate electromagnetic interferences (EMI) or crosstalk from internal and external sources, signals may be more quickly and stably transmitted via the connector.

What is claimed is:

1. A connector, comprising a plastic core, a set of terminals, a set of first isolating plates, two first conductive plates, and an insertion element;

said plastic core being provided on an inner central portion at upper and lower sides thereof with upper and lower receiving slots, and at an area of said inner central portion between said upper and lower receiving slots with a plurality of alternately arranged terminal slots and isolating plate slots, said terminal slots being divided into an upper and a lower row; and said plastic core also being provided at each of two lateral inner sides with a slide way;

said set of terminals including a plurality of terminals adapted to separately locate in said upper and lower rows of terminal slots on said plastic core;

said set of first isolating plates including a plurality of first isolating plates adapted to separately locate in said isolating plate slots on said plastic core;

said two first conductive plates being separately inserted into said upper and lower receiving slots on said plastic core; and said insertion element having two lateral sides slidably engaged with said slide ways on said plastic core and thereby being firmly held in said plastic core and said insertion element having a transverse central receiving slot, in which a second conductive plate is received.

2. The connector as claimed in claim 1, wherein said upper and lower receiving slots on said plastic core are separately provided with one or more ribs.

3. The connector as claimed in claim 1, wherein said two first conductive plates are provided with one or more slits.

4. The connector as claimed in claim 1, wherein said insertion element is provided at upper and lower sides with second isolating plates corresponding to said set of terminals.

5. A connector, comprising a plastic core, a set of terminals, a set of first isolating plates, two first conductive plates, an insertion element, and two outer covers;

said plastic core being provided on an inner central portion at upper and lower sides thereof with upper and lower receiving slots, and at an area of said inner central portion between said upper and lower receiving slots with a plurality of alternately arranged terminal slots and isolating plate slots, said terminal slots being divided into an upper and a lower row; and said plastic core also being provided at each of two lateral inner sides with a slide way;

said set of terminals including a plurality of terminals adapted to separately locate in said upper and lower rows of terminal slots on said plastic core;

said set of first isolating plates including a plurality of first isolating plates adapted to separately locate in said isolating plate slots on said plastic core;

said two first conductive plates being separately inserted into said upper and lower receiving slots on said plastic core; and said insertion element having two lateral sides slidably engaged with said slide ways on said plastic core and thereby being firmly held in said plastic core; and said two outer covers being located at upper and lower sides of said insertion element to enclose said insertion element in said plastic core; said outer covers being provided at respective inner side with a plurality of isolating ribs, and internally provided at a central position with a transverse recess, into which a third conductive plate is received; and said third conductive plates received in said two outer covers being separately in contact with said first conductive plates received in said upper and lower receiving slots on said plastic core.

6. The connector as claimed in claim 5, wherein said upper and lower receiving slots on said plastic core are separately provided with one or more ribs.

7. The connector as claimed in claim 5, wherein said transverse recesses on said outer covers are internally provided with one or more ribs.

8. The connector as claimed in claim 5, wherein said first and said third conductive plates are provided with one or more slits.

9. The connector as claimed in claim 5, wherein said insertion element is provided with a transverse central receiving slot, in which a second conductive plate is received.

10. The connector as claimed in claim 5, wherein said insertion element is provided at upper and lower sides with second isolating plates corresponding to said set of terminals.

11. The connector as claimed in claim 5, wherein said insertion element is a printed circuit board.

* * * * *